US005655598A

United States Patent [19]

Garriss et al.

[11] Patent Number: 5,655,598

[45] Date of Patent: Aug. 12, 1997

[54] APPARATUS AND METHOD FOR NATURAL HEAT TRANSFER BETWEEN MEDIUMS HAVING DIFFERENT TEMPERATURES

[76] Inventors: John Ellsworth Garriss, 2919 Salford Dr.; Daniel Edward Garriss, 2612 Colpepper Rd., both of Abingdon, Md. 21009; Brian Joseph Garriss, 701 Eastwood Ct., Bel Air, Md. 21014

[21] Appl. No.: 531,160

[22] Filed: Sep. 19, 1995

[51] Int. Cl.[6] ..... F28D 15/00

[52] U.S. Cl. ..... 165/104.14; 165/104.21

[58] Field of Search ..... 165/104.21, 104.26, 165/104.33, 104.12, 104.14, 54; 257/715; 361/700

[56] References Cited

U.S. PATENT DOCUMENTS

| | | | |
|---|---|---|---|
| 1,725,906 | 8/1929 | Gay | 165/104.21 |
| 2,529,915 | 11/1950 | Chausson | 165/104.21 X |
| 3,125,159 | 3/1964 | Lindberg, Jr. | 165/104.12 X |
| 3,653,433 | 4/1972 | Scharli | 165/104.33 X |
| 3,834,171 | 9/1974 | Johansson | 165/104.26 X |
| 3,902,547 | 9/1975 | Waters | 165/104.21 X |
| 3,962,529 | 6/1976 | Kubo | 165/104.21 X |
| 4,295,342 | 10/1981 | Parro | 62/119 |
| 4,314,601 | 2/1982 | Giuffre et al. | 165/104.21 X |
| 4,688,399 | 8/1987 | Reimann | 62/485 |
| 4,771,824 | 9/1988 | Rojey et al. | 165/104.13 |
| 4,896,716 | 1/1990 | Sotani et al. | 165/54 |
| 4,930,570 | 6/1990 | Okayasu | 165/104.14 |
| 5,168,919 | 12/1992 | Berenholz et al. | 165/104.33 X |
| 5,203,399 | 4/1993 | Koizumi | 165/104.33 |

FOREIGN PATENT DOCUMENTS

| | | | |
|---|---|---|---|
| 0116093 | 9/1980 | Japan | 165/104.21 |
| 0232448 | 12/1984 | Japan | 165/104.33 |
| 4089452 | 4/1989 | Japan | 257/715 |
| 1-264247 | 10/1989 | Japan | 257/715 |
| 3-190153 | 8/1991 | Japan | 257/715 |
| 1032322 | 7/1983 | U.S.S.R. | 165/104.21 |

*Primary Examiner*—John Rivell
*Assistant Examiner*—Christopher Atkinson
*Attorney, Agent, or Firm*—Leonard Bloom

[57] ABSTRACT

An apparatus for heat exchange between a heat source medium and a heat sink medium comprises a two-dimensional array of heat transferring individual modules. Each module comprises a header, an evaporator, extended from one side of the header into the heat source medium, and a condenser extended from another side of the header into the heat sink medium. The evaporator is located below the condenser and each one includes a U-shaped tube affixed to the header in a canted position. The module is charged with a heat transport medium existing in the module in both liquid and vapor phases. The heat transport medium within the evaporator receives a heat energy from the heat source medium and transports the received heat energy to the condenser, thereby cooling the heat source medium and thereby heating the heat sink medium.

33 Claims, 9 Drawing Sheets

APPARATUS AND METHOD FOR NATURAL HEAT TRANSFER BETWEEN MEDIUMS HAVING DIFFERENT TEMPERATURES

FIELD OF THE INVENTION

The present invention relates to an apparatus and method for heat reclaim and recovery, and more particularly, to a high-efficiency and energy-conserving heat transferring system utilizing a multi-dimensional array of heat transferring individual modules.

BACKGROUND OF THE INVENTION

For improving indoor air quality ("IAQ") in habitable working and living spaces and the like, the air is exhausted from the space to the atmosphere (or to another space) and is replaced by outside air which must be heated or cooled in order for the desired temperature within the space to be maintained. Equipment for improvement Indoor Air Quality is known in the art. It includes ventilation systems consuming a substantial amount of energy for heating or cooling the incoming air. Also, the advanced more efficient and energy conserving counter-flow heat exchangers were developed to transfer some heat to or from the air supplied to the space by heat exchange with the air removed therefrom.

For instance, U.S. Pat. No. 4,295,342 discloses a system wherein a heat exchange is effected in a simple and economical manner by allowing natural flow of a heat exchange fluid (such as a conventional refrigerant liquid) between two heat exchangers which are exposed to air at different temperatures. The two heat exchangers, which may conveniently take the form of fin-tube heat exchangers, are arranged with one end at a higher elevation than the other. As the refrigerant liquid absorbs heat and evaporates in the heat exchanger exposed to the warmer air, the vapor travels through the upper connecting line to the other heat exchanger, where it rejects heat and is condensed, the liquid flows through the lower connecting line back to the first heat exchanger, and so on, with heat exchange between the two air streams or masses occurring during the natural, continuous flow of the refrigerant in gaseous and liquid form.

U.S. Pat. Nos. 4,688,399, 4,771,824 and 4,896,716 also disclosed heat pipe heat exchangers with increased efficiency of transferring the heat from a heat source to a heat sink.

Disadvantageously, heat-pipe heat exchangers suffer from certain problems:

- a length limitation, wherein the capacity of the heat pipe does not increase when the length of the heat pipe is extended beyond a certain maximum.
- in a heat pipe, a liquid and a vapor are moving in opposite directions, each impeding the flow of the other.
- when a heat pipe utilizes wicking to return liquid phase condensate to the warm end, a definite limit is placed on the length over which the wick can be effective.
- leakage causing cross-contamination through intermixing of the fluid streams.

It, therefore, would be highly desirable to have a heat transferring system overcoming the disadvantages of the prior art.

SUMMARY OF THE INVENTION

It is, therefore, an object of the present invention to provide an energy conserving apparatus with variable heat transfer and fluid flow capacity for the natural transfer of heat energy from a warm heat-source medium to a cooler heat-sink medium.

It is another object of the present invention to provide a heat transferring system comprising a multi-dimensional array of identical heat transferring individual modules.

It is yet another object of the present invention to provide an individual module for a multi-modules heat transferring system, wherein the module will be able to perform as a thermosiphon for transferring heat from a warmer heat-source medium to a cooler heat-sink medium.

It is further an object of the present invention to provide a high-efficient and energy conserving method for heat reclaim and recovery.

It is a further object of the present invention to provide an economical auxiliary means to a ventilation system which in the winter season passively (automatically) extracts a waste heat from a ventilation exhaust air stream and transfers this heat into incoming fresh air supply streams, and in the summer season passively extracts heat from incoming fresh air supply stream and transfers the heat into the cool air being exhausted from the habitable place, thereby reclaiming heat and electrical energy.

The present invention finds its particular utility as a means for improving indoor air quality; however, the principles of the present invention are applicable in any situation where a passive heat transfer between two media (air and/or liquid) having different temperatures is desired.

According to the teachings of the present invention, an apparatus for heat exchange between a heat source medium and a heat sink medium comprises a multi-dimensional (preferably, two-dimensional) array of heat transferring individual modules. The modules are cascaded in series along a border separating streams of the heat source medium and the heat sink medium, and the cascades of the modules are further arranged in tiers in a plane separating the above streams.

Each module comprises a header having an upper portion and a lower portion, and first and second opposite sides, respectively. An evaporator means extends from the first side of the header into the heat source medium, and a condenser means extends from the second side of the header into the heat sink medium. The evaporator means preferably is a U-shaped tube affixed to the lower portion of the header through a first and a second pass thereof. The condenser means includes a U-shaped tube affixed to the upper portion of the header through a third and a fourth pass thereof. The module is charged with a heat transport medium existing in the module in both liquid and vapor phases. A liquid level interface surface is formed between the liquid phase and the vapor phase of the heat transport medium within the header. The liquid level interface surface separates the upper portion of the header from its lower portion, such that the evaporator means is located below the liquid level interface surface and is filled with the liquid phase of the heat transport medium, and such that the condenser means is located above the liquid level interface surface and is filled with the vapor phase of the heat transport medium. The heat transport medium within the evaporator means receives a heat energy from the heat source medium and automatically (or passively) transports the received heat energy to the condenser means through the liquid level interface surface, thereby cooling the heat source medium and thereby heating the heat sink medium with no consumption of any additional electrical (or other) energy. The heat energy of the heat source medium is not wasted but, on the contrary, is utilized and reclaimed. The first and the second pass of the header are located at different levels, similar to the third and the fourth pass which are also located at different levels.

An internal surface of the condenser means is treated (by either serrating, rifling, micro-finning or coating) to increase the internal surface area involved in the heat energy transferring.

An ebulator is located within the U-shaped tube of the evaporator means and extends a full length thereof. Preferably, the ebulator is of a triangular cross-sectional shape.

Each module is hermetically sealed and internally evacuated. By means of varying the elevation of the condenser means above the evaporator means, and by varying the quantity of the heat transport medium charged into the module, the effectiveness of the module can be varied.

Preferably, an interface surface pan is installed within the header to receive, fill and overflow with condensate effluent from the condenser means. The header may be either of an oval shape, shaped as a rectangular extrusion, or as a circular tube.

By varying a number of modules in the two-dimensional array, dimensions of the header, length and diameter of the U-shaped evaporator and condenser tubes, a capacity of the apparatus and an overall quantity of heat transferred may be alternated. U-shaped tubing for the evaporator and the condenser is suitable for this application, since other shapes may complicate the manufacturing process and increase production costs.

In order to implement high-efficient and energy-conserving method of heat reclaim and recovery by a passive heat exchange between a warmer heat source medium and a cooler heat sink medium, a plurality of substantially identical heat transferring individual modules of the present invention are arranged in a two-dimensional array in a plane separating the heat source medium and the heat sink medium, such that the evaporator means of all modules are extended into the heat source medium, and the condenser means of all modules are extended into the heat sink medium.

The apparatus of the present invention may be installed at a ventilation system supplying fresh outside air to a habitable space and removing an exhausted air therefrom. The incoming fresh outside air must be warmed or cooled subject to the season of the year in order to maintain a comfortable temperature in the habitable space. During the winter season the apparatus transfers the heat energy from the exhausted air to the incoming air, while during the summer season the heat energy is transferred from the incoming air to the exhausted air. The ventilation system includes a first and a second reversible fan, such that during the winter season, the first fan drives the incoming fresh outside air to flow over the condenser means of the modules, and the second fan drives the exhausted air to flow over the evaporator means of the modules, thereby providing the heat energy transfer from the exhausted air to the incoming fresh outside air. During the summer season, the first fan drives the incoming fresh outside air to flow over the evaporator means of the modules, and the second fan drives the exhausted air to flow over the condenser means of the modules, thereby providing the heat energy transfer from the incoming fresh outside air to the removed exhausted air, and thereby reclaiming a heat energy of the air to be cooled.

These and other objects of the present invention will become apparent from a reading of the following specification taken in conjunction with the enclosed drawings.

DETAILED DESCRIPTION OF THE INVENTION

Figure 1:
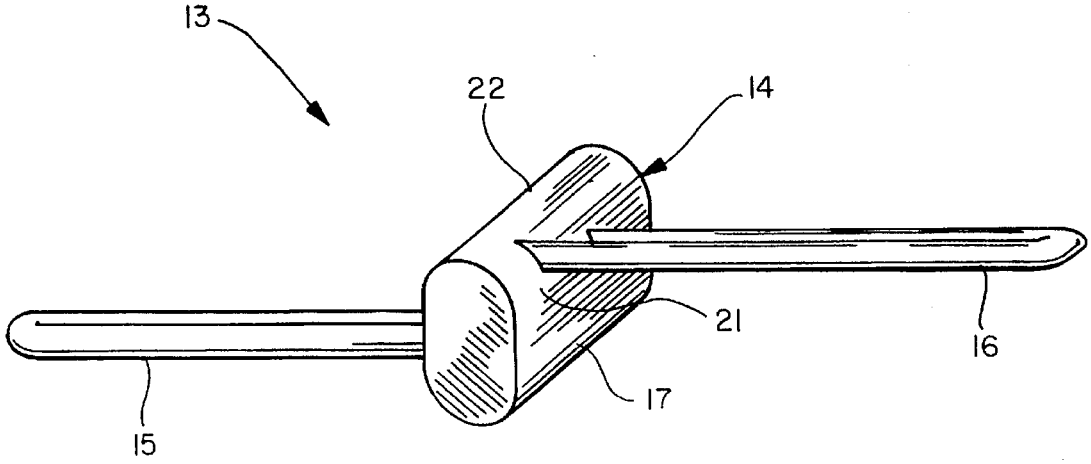
FIG. 1 is a perspective view of a heat transferring individual module of the present invention.

With reference to FIGS. 1–5, 9–11 and 14A–14D, an apparatus 10 for heat exchange between a heat source medium 11 and a heat sink medium 12 (best shown in FIG. 11) comprises heat transferring individual modules 13. Each module 13 includes three integrated elements: a header 14, an evaporator 15 and a condenser 16. The header 14 has an upper portion 22 and a lower portion 17. The evaporator 15 is a U-shaped tube affixed to a lower portion 17 of the header 14 through a first pass 18 and a second pass 19 and is extended from an evaporator side 20 of the header 14 into the heat source medium 11. The condenser 16, extended from condenser side 21 of the header 14 into the heat sink medium 12, is a U-shaped tube affixed to an upper portion 22 of the header 14 through a third pass 23 and a fourth pass 24.

Figure 3:
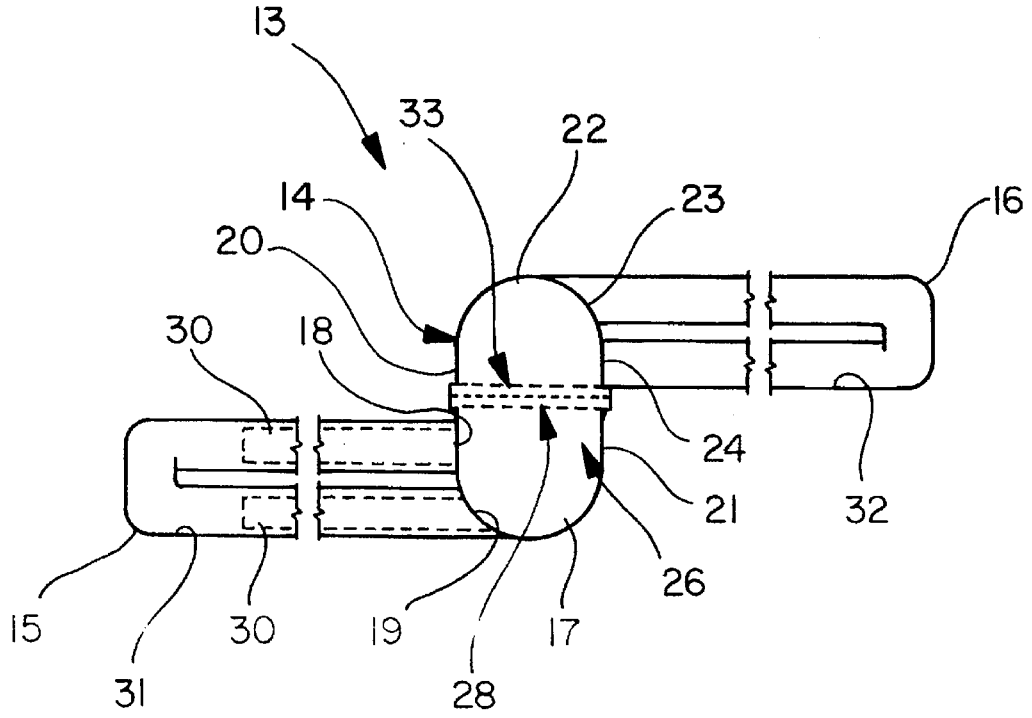
FIG. 3 is a front view of the module of FIG. 1.
Figure 4:
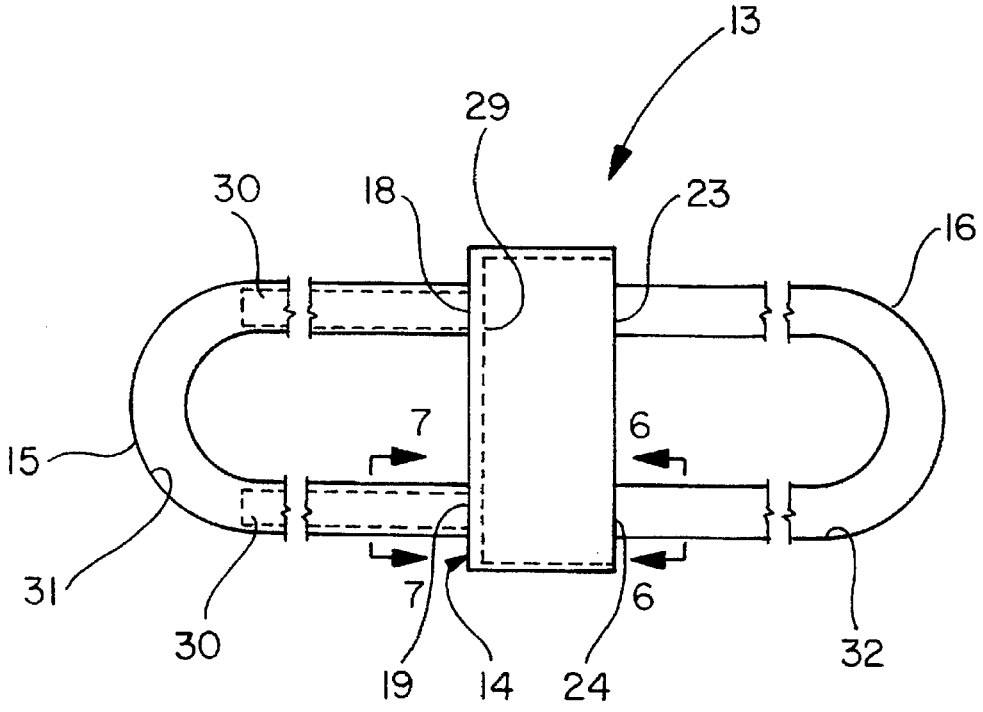
FIG. 4 is a plan view of the module of FIG. 1.
Figure 5:
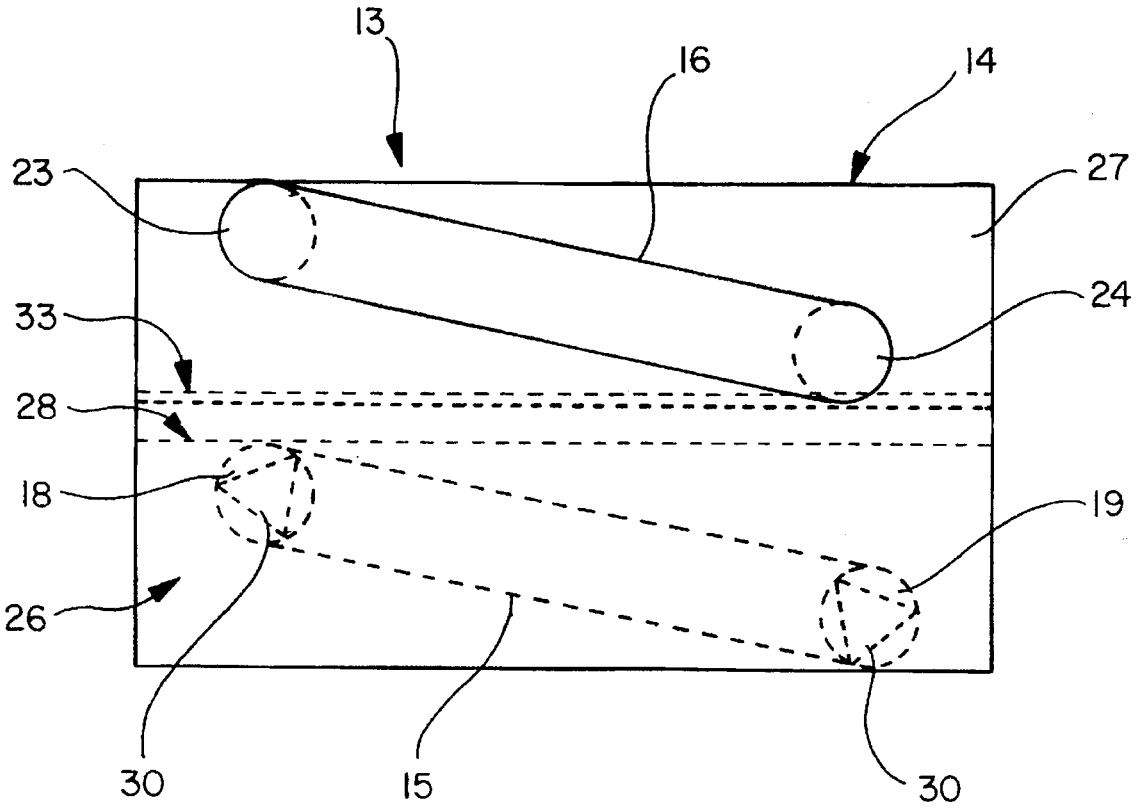
FIG. 5 is a condenser side view of the module of FIG. 1, showing the evaporator in invisible lines.
Figure 6:
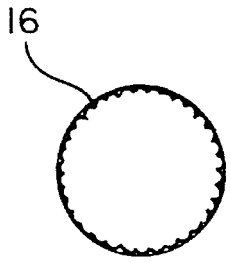
FIG. 6 is a cross-sectional view of the condenser of FIG. 4 taken along lines 6—6.
Figure 9:
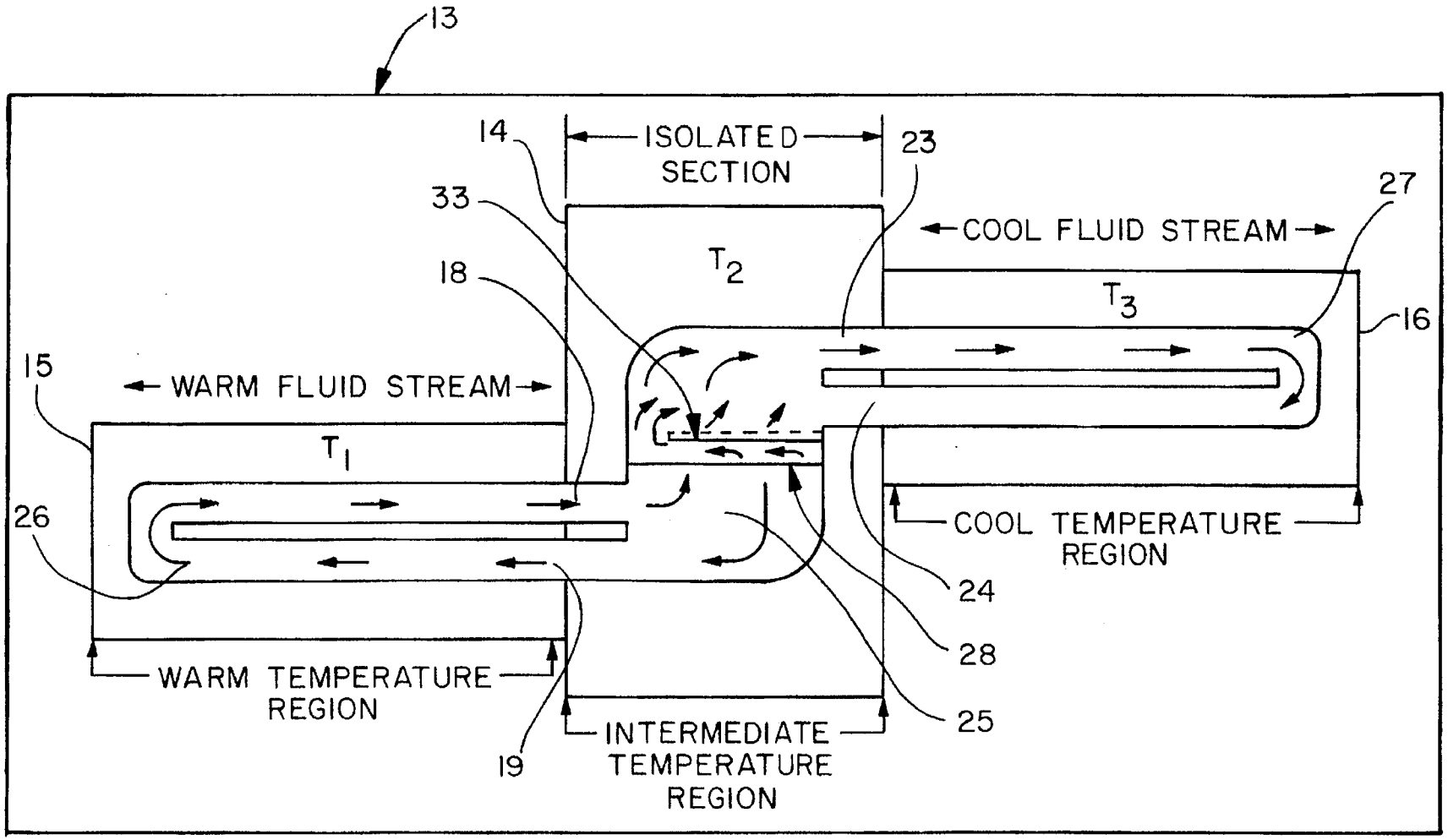
FIG. 9 shows a longitudinal cross-section of the module of the present invention charged with the heat transport medium.

The module 13 is charged with a measured quantity of heat transport medium 25 existing in the module 13 in both liquid 26 and vapor 27 phases. The heat transport medium 25 may either include any refrigerant comprising water ($H_2O$) and ammonia ($NH_3$) or any compound having the most suitable physical property for the temperature range in which it is applied, even those not usually classified as refrigerants. A relatively large liquid level interface surface 28 is formed between the liquid phase 26 and the vapor phase 27 of the heat transport medium 25 within the header 14. As best shown in FIGS. 3, 5 and 9, the liquid level interface surface 28 separates the upper portion 22 of the header 14 from the lower portion 17 thereof, such that the evaporator 15 is located below the liquid level interface surface 28 and is filled with the liquid phase 26 of the heat transport medium 25, while the condenser 16 is located above the liquid level interface surface 28 and is filled with the vapor phase 27 of the heat transport medium 25.

An interface surface pan (or a catch pan) 29 is installed within the header 14 to receive a condensate effluent from the condenser 16 into the header 14, so that the liquid level interface surface 28 is expanded over the surface of the body of liquid phase 26 of the heat transport medium 25 contained in the header 14 and over the surface of the liquid phase 33 held in the interface surface pan 29.

As best shown in FIGS. 14A–14D, the header 14 may be designed to have any shape that will provide an optimal interface surface 28 in the plane of the liquid phase level, for instance, of oval shape, as a rectangular entrusion or a circular tube, or "Zee"-shaped.

It will be appreciated by those skilled in the art that change of state from liquid to vapor in the evaporator takes place in two ways, which depend on the magnitude of temperature difference between the liquid phase and the heat source. At small temperature differences, phase change takes place primarily on the molecular scale at the liquid/vapor interface surfaces. Under same conditions this surface evaporation rate increases in direct proportion to an increase in the total amount of interface surface area. At the larger temperature differences, a nucleate boiling occurs where vapor bubbles are formed on interior heat exchange surfaces within the body of liquid. These bubbles rise due to the effect of gravity, cross the interface, and merge with the contiguous body of vapor. The rate of release and degree of freedom for the vapor bubbles to make this transition is directly related to the total interface surface area in combination with other accommodations, such as, for example, available gravity head height, whether tubes of the evaporator 15 and the condenser 16 angled (or canted) in the direction of natural bubble ascent toward the interface surface.

The heat transport medium 25 within the evaporator 15 receives a heat energy from the heat source medium 11, evaporates (thereby cooling the heat source medium 11), and transports the obtained heat energy to the condenser 16 through the liquid level interface surface 28. In the condenser 16, the vapor releases the transported heat energy to the heat sink medium 12 (thereby warming the latter) and condensates.

Figure 8:
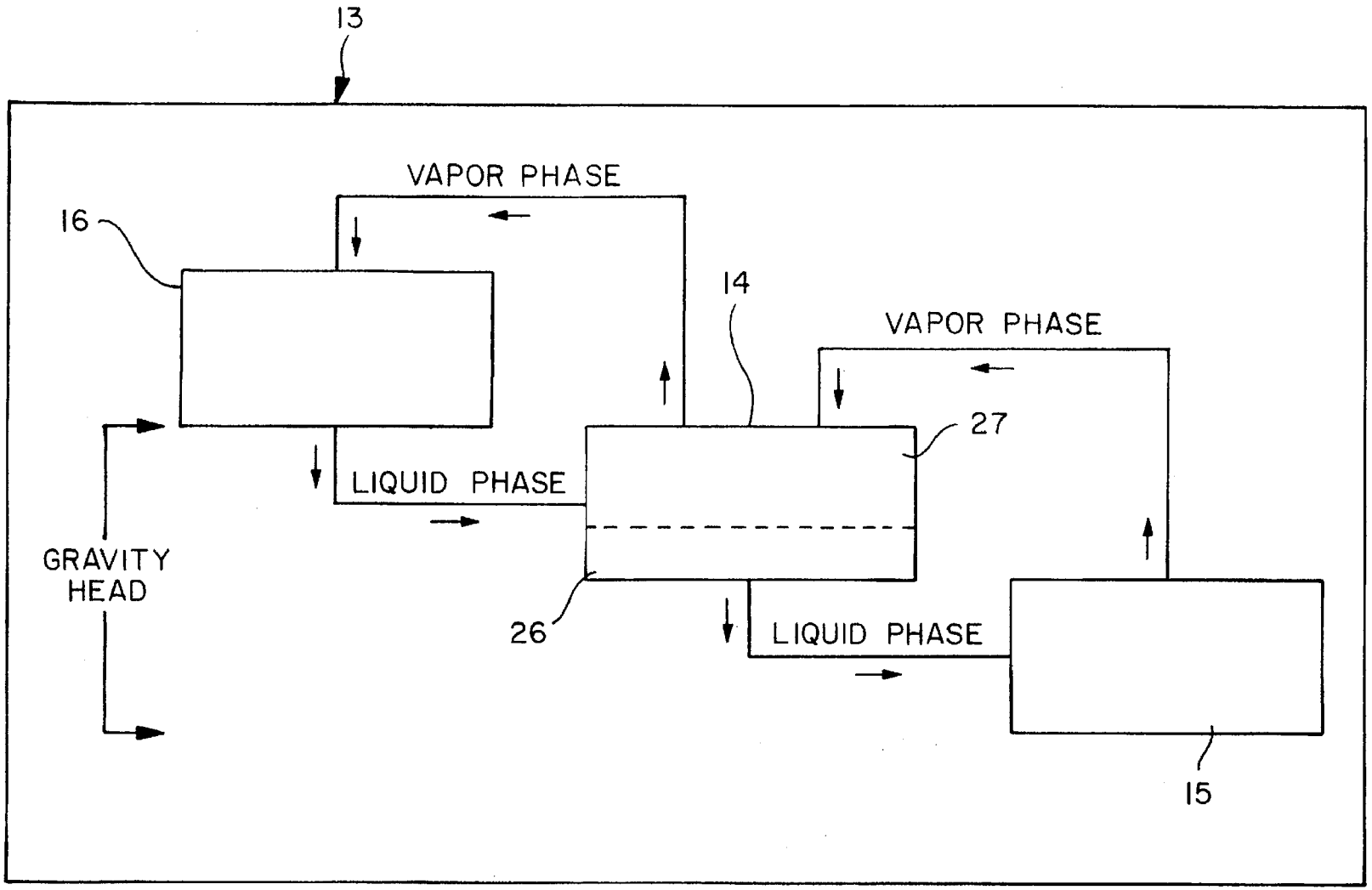
FIG. 8 is a schematic representation of operational principles of the individual module of the present invention.

The flow path of the heat transport medium 25 and its matter state along that path is best shown in FIGS. 8 and 9. A difference in temperature between the heat source medium 11 and heat sink medium 12 is the driving force which moves both mass and heat energy totally within the body of the volatile phase-change transport medium 25. Under steady-state conditions with heat energy entering and leaving the phase change system, the heat transport medium 25 comes to an equilibrium saturation condition which falls at an intermediate set of pressure/temperature values between the heat source medium 11 and heat sink medium 12 temperatures. Heat energy obtained by the portion of the heat transport medium 25 in the liquid state in the header 14 and in the evaporator 15 changes part of the liquid phase 26 into the vapor phase 27 with no accompanying increase in either temperature or pressure. Temperature does not increase because changes of state take place at a constant temperature and constant pressure. Pressure remains at an equilibrium value during the operation of the module 13 because the volume of vapor phase 27 generated by a liquid-to-vapor change occurring in the evaporator 15 is balanced by the simultaneous condensing of an equal volume of vapor phase 27 in the condenser 16. In this on-going, cyclic process vapor flows continuously from the evaporator 15 and the header 14 to the condenser 16, representing a flow of mass, and carrying with that mass the latent heat energy that it gained in changing state. When that heat laden vapor enters the condenser 14, the opposite change of state occurs. The vapor gives up heat to the heat sink medium 12 and condenses back to its original liquid form. The resultant liquid phase, or condensate, flows back to the header 14 and the evaporator 15 under the influence of the gravity head produced by the difference in the elevation between the evaporator 15 and the condenser 16, and by the downward cant of the condenser 16, thus draining and freeing the condenser 16 from detrimental entrainment of liquid, and completing the cycle of operation.

The continuous cycle of the operation of the module 13 begins when the heat energy is transferred at low temperature difference from the stream of the heat source medium 11 to the liquid phase 26 of the heat transport medium 25 in the evaporator 15, increasing the rate of vapor generated by surface evaporation at the liquid level interface surface 28 and the interface surface in the catch pan 29 located in the header 14, and tending to raise vapor pressure in the module 13. Simultaneously, the heat energy transferred from the vapor phase 27 to the heat sink medium 12 stream by the condenser 16, causes film condensation on interior surfaces, tending to reduce vapor pressure in the module 13.

Figure 7:
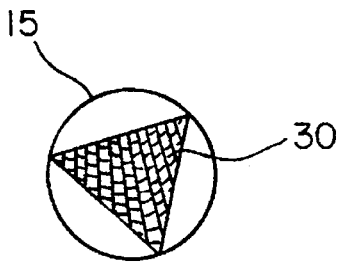
FIG. 7 is a cross-sectional view of the evaporator of FIG. 4 taken along lines 7—7.

As best shown in FIGS. 3–7, the evaporator 15 is fitted internally with an ebulator 30 to initiate early and to sustain liquid phase nucleate boiling at smaller temperature differences than it would be possible without them. The ebulator 30 can be of various shapes and composition materials providing a multiplicity of surface nodes which are conducive to the formation and propagation of the nucleate boiling phenomena. The liquid phase 26 contained in the evaporator 15 extends into the partially liquid filled header 14 up to the liquid level interface surface 28, forming a homogeneous body of fluid. Convection currents are created within that liquid phase body residing in the header 14, and in the annular spaces surrounding the ebulator 30, due to a temperature gradient between the portion of the liquid being in direct heat exchange contact in the evaporator 15 and the portion of the liquid in the cooler header 14 location. The ebulator 30 serves to reduce the cross-section area of the evaporator 15 tube resulting in increased sweeping action of flow velocity of liquid moving over these surfaces, thus improving performance in both the evaporative and nucleate boiling stages. The preferred ebulator, as best shown in FIG. 7, is a three-sided (triangular) solid ebulator with the points of the triangle touching the inside tube walls and extending along the full length of the heat transfer tube of the evaporator 15.

The performance efficiency of the module 13 is improved by rifling, serrating, creating microfin surface, or coating the interior of all heat transfer surfaces for the purpose of increasing the area involved in the process of heat transferring. By treating the interior surface 31 of the evaporator 15, the evaporation and boiling processes are intensified. By treating the interior surfaces of the condenser 16, the process of vapor film condensation is improved.

Figure 2A:
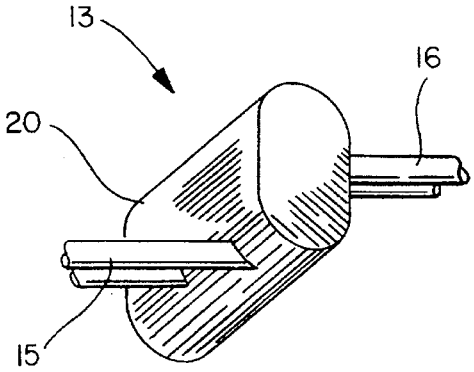
FIG. 2A shows on an enlarged scale an evaporator side of the module of FIG. 1.
Figure 2B:
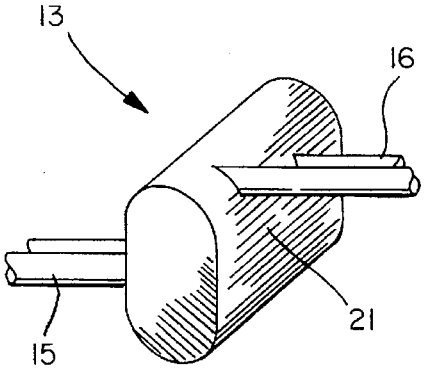
FIG. 2B shows on an enlarged scale a condenser side of the module of FIG. 1.

As best shown in FIGS. 1–3, the condenser 16 is positioned at an elevation above the evaporator 15. The difference in elevation and quantity of the heat transport medium 25 charged into the module 13 is designed to place the liquid level interface surface 28 (or liquid level) at an elevation between that of the evaporator 15 and the condenser 16. Thus, due to the effect of gravity, the evaporator 15 is below the interface 28 and remains completely filled with denser liquid phase 26 while the condenser 16 is above the interface 28 and remains completely filled with the lighter vapor phase 27.

As best shown in FIG. 5, the evaporator 15 is canted at angle and is submerged below the liquid level interface surface 28, with one end (first pass) 18 at the lower liquid depth and the other end (second pass) 19 at a higher elevation just under the interface surface 28 level. With the evaporator 15 canted upward in the direction of natural convective movement due to gravitational force, the less dense liquid will rise and flow more rapidly to the liquid level interface surface 28 at the upper surface level. The faster these convective circulating currents move, the better will be the statistical chances that the greatest number of bubbles and high energy molecules will arrive at, and move across, the liquid level interface surface 28 under both evaporative and nucleate boiling conditions.

The condenser 16 heat exchanger is also shown to be canted at an angle and is completely above the liquid level interface surface 28, with one end (third pass) 23 at an upper elevation and the other end (fourth pass) 24 at a lower elevation just above the interface surface pan 33. The direction of natural movement of the phase change medium is downward due to the force of gravity exerted on the dense droplets of liquid formed on the inside walls of the condenser 16 in the process known as a "film condensation". The canted angle given to the condenser 16 heat exchanger provides a free, downward path for the natural flow of these droplets out of the condenser, preventing their accumulation and retention in the condenser 16 which is a major cause of cycle hysteresis in thermosiphon and heat pipe devices.

Physical configuration, shape, relative spatial position of components to each other, angular relationship, and volumetric ratios are important design features integrated in the module 13.

All sizes and capacities of modules 13 configured as represented in FIGS. 1–11, operate to transfer and transport heat from one fluid stream to the other over the full range of temperature difference between the streams. Heat transfer begins automatically whenever the minimum temperature difference needed for overcoming heat flow and fluid flow resistance is established. From this point module heat transfer capacity increases in infinite increments until the maximum heat transfer rate is reached at the maximum temperature difference between the fluid streams.

Modules 13 characteristically transport heat in one direction, i.e., the evaporator 15 is the heat receptor and the condenser 16 is the heat donor. No significant quantity of energy can be transported in the reverse direction.

The header 14 is a unique element of this invention having important multiple purposes in addition to those stated above:

- The header 14 functions to provide a large internal cross-section area offering minimal wall friction and phase counterflow resistance to the liquid phase 26 flowing from the condenser 16 to the evaporator 15 and to the vapor phase 27 flowing from the evaporator 15 to the condenser 16.
- The header 14 functions as a liquid phase 26 collection receiver and a reservoir to insure adequate quantity of liquid feed supply to the evaporator 15 under wide variations in heat transfer loading imposed on the module 13 over the full range of operational temperature differences between source and sink medium streams.
- The header 14 functions as one of the module 13 components designed to eliminate conditions known to be responsible for performance hysteresis in thermosiphon and heat pipe systems of the prior art. One condition is the interference set up by counterflow of liquid and vapor phases moving in opposite directions through conduits of unchanging cross-section areas in these systems causing back-up of liquid phase, or entrainment, in condenser heat exchangers. A second detrimental hysteretic condition develops from that of the said entrainment. That part of the limited total amount of liquid phase contained in these systems which is entrained in the condenser is not available to adequately feed the evaporator, resulting in evaporator "starvation". The header 14 of this invention is designed to eliminate or reduce hysteresis to a minimum through the functions described above.

Figure 10:
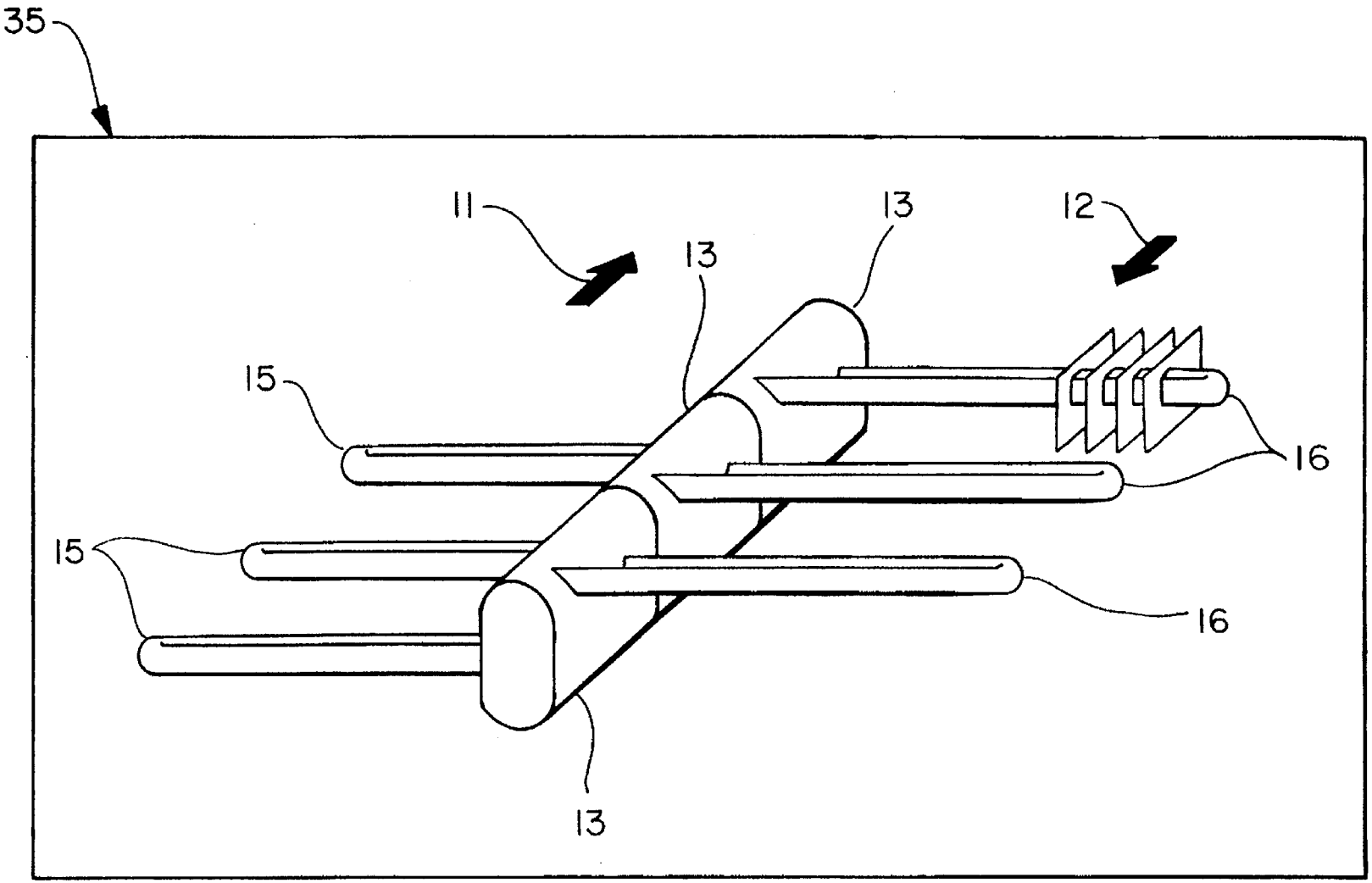
FIG. 10 shows a group of modules of FIG. 1 cascaded serially along a plane separating flow paths of the heat source and heat sink mediums.
Figure 11:
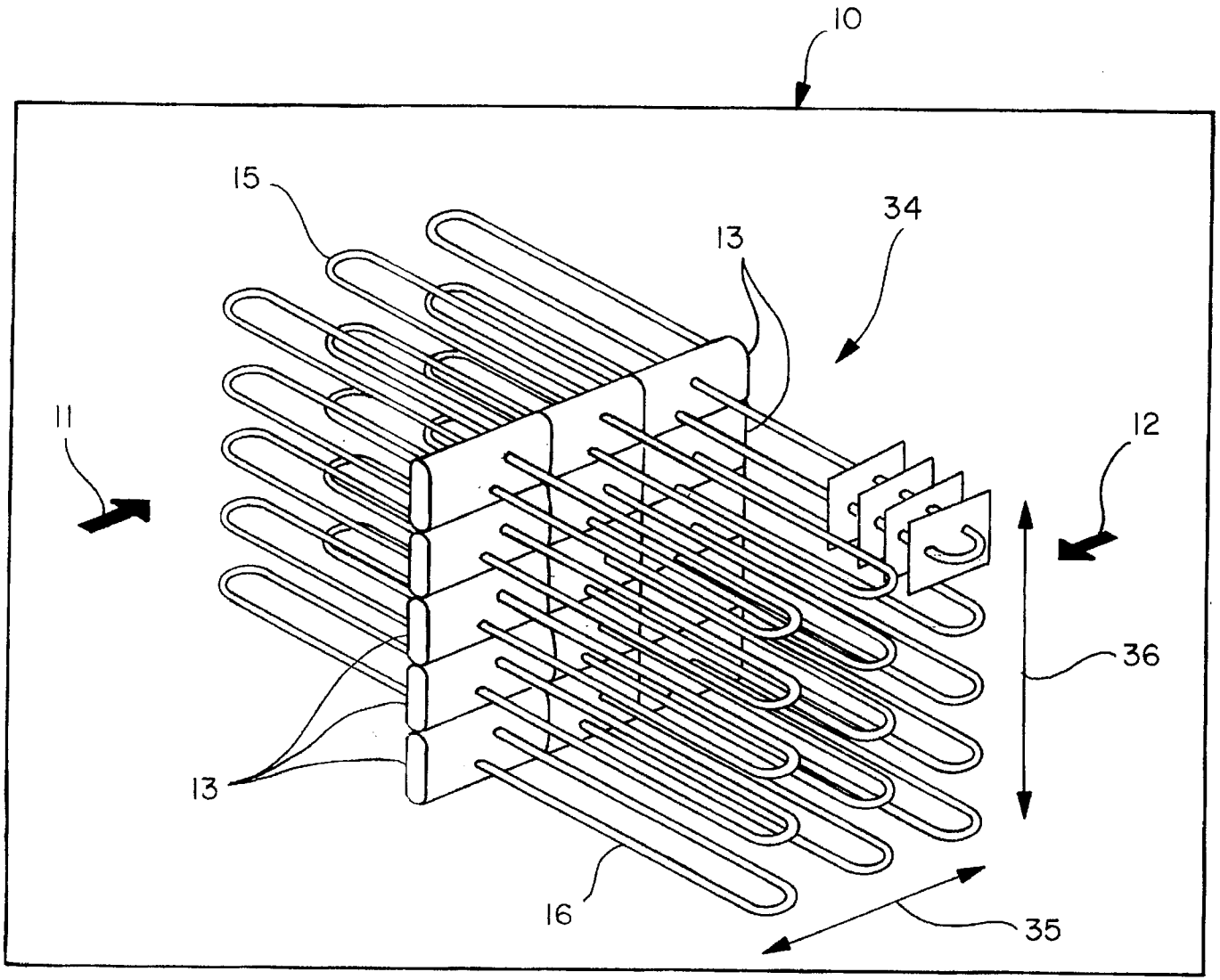
FIG. 11 shows a two-dimensional array of the individual modules of the present invention.

As best shown in FIGS. 10 and 11, the modules 13 are integrated in a two-dimensional array (or into a single unit) 34. Individual modules 13 are designed for use in two-dimensional array 34 consisting of a multiplicity of modules 13 cascaded in series 35 along a "border" separating heat source medium 11 and heat sink medium 12 flow paths to yield high performance efficiency, and stacked in a multiplicity of these cascaded groups 35 in tiers 36 arranged in a plane 37 separating the medium 11 and 12 flow paths to obtain variation in overall total quantities of heat transfer and fluid flow capacities. Capacity of the array 34 can be made variable by up-scaling or down-scaling the physical size of individual modules 13 in total amount of the heat transfer surface area contained, tubing diameters and length, and the header 14 physical dimensions. Also, different transport mediums 25 may be used in each of the modules 13 in the same cascade series 35 to optimize performance of the apparatus 10.

It will be appreciated by those skilled in the art, that the modules 13 are arranged in a two-dimensional array 34 in the plane 37 separating the heat source medium 11 and the heat sink medium 12, such that the evaporators 15 of each module 13 are extended from the evaporator side 20 of each header 14 into the heat source medium 11, and the condensers 16 of each module 13 are extended from the condenser side 21 of each header 14 into the heat sink medium 12, and such that the heat transport medium 25 within each evaporator 15 receives a heat energy from the heat source medium 11 and transports the received heat energy to the respective condenser 16 through the liquid level interface surface 28, thereby cooling the heat source medium 11 and thereby heating the heat sink medium 12.

One of a plurality of applications of the system of the present invention includes employing the array 34 of the heat transferring individual modules 13 as a auxiliary means in a ventilation system for improving indoor air quality in habitable working and living spaces.

Figure 12:
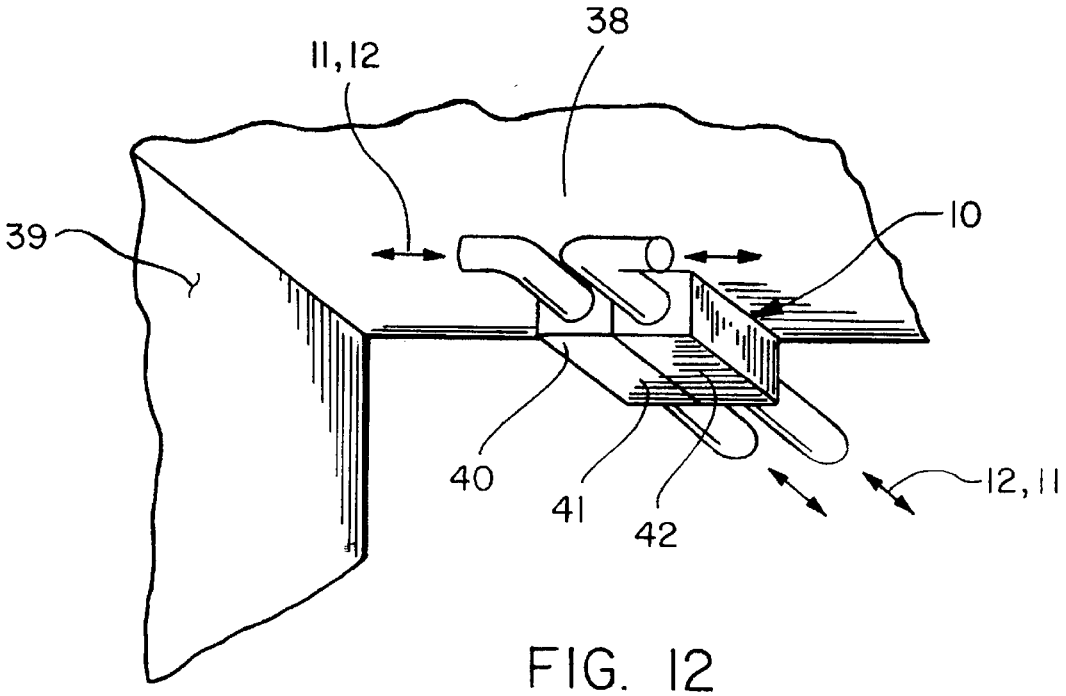
FIG. 12 shows schematically a ventilation system with installed therein the two-dimensional heat transferring apparatus of the present invention.
Figure 13:
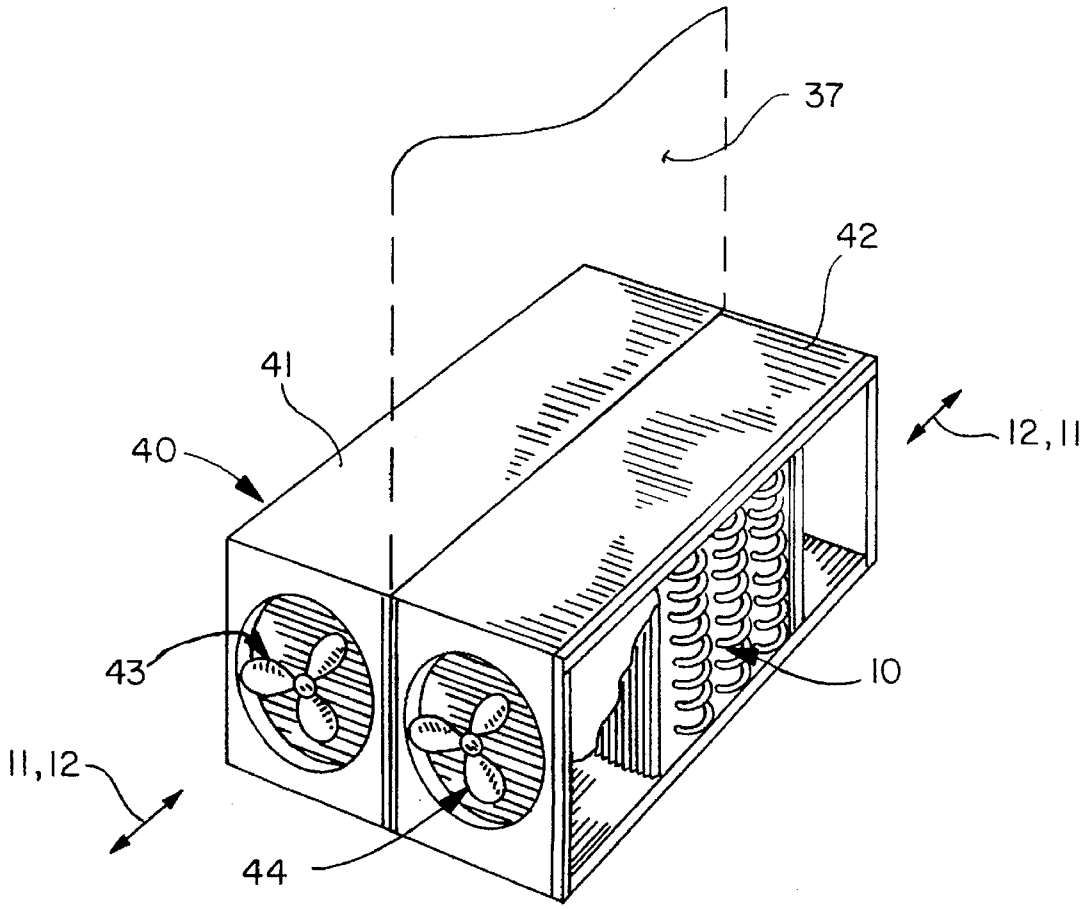
FIG. 13 shows a casing with the apparatus of the present invention and two reversible fans for employing with a ventilation system.
Figure 14A:
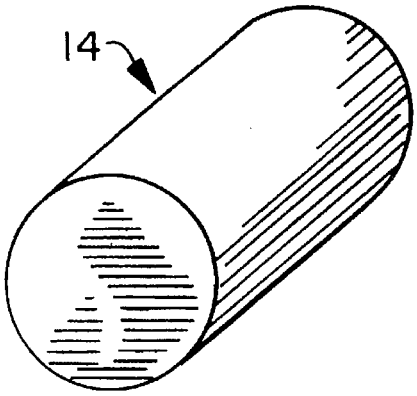
FIGS. 14A–14D show alternative shapes of the header.
Figure 14B:
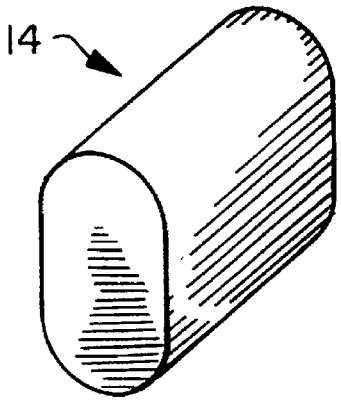
Figure 14C:
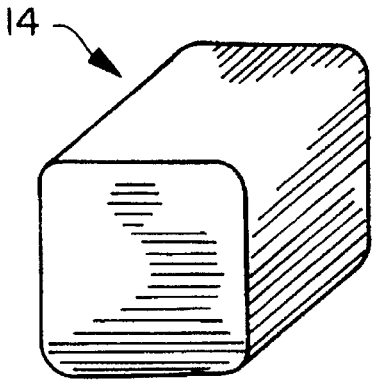
Figure 14D:
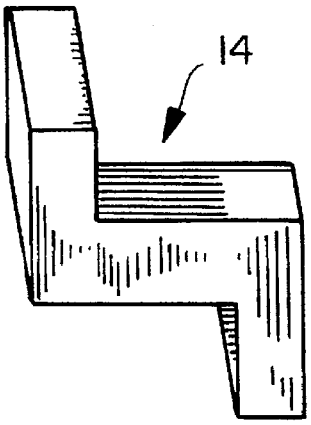

Referring to FIGS. 12 and 13, the apparatus 10 of the present invention is used in combination with a ventilation system 38 supplying a fresh outside air to a habitable space 39 and removing an exhausted air therefrom. The incoming fresh outside air is to be warmed or cooled subject to the season of the year in order to maintain a comfortable temperature in the habitable space 39. The apparatus 10 is installed on the ventilation system 38 for passive heat exchange between the incoming fresh outside air and the removed exhausted air in order to warm or cool the incoming fresh outside air with no electrical (or other) energy consumption. As best shown in FIG. 13, the two-dimensional array 34 of substantially identical heat transferring individual modules 13 is installed in a casing 40 separated onto two chambers 41 and 42 serving as a cool air stream casing, for example, 41, and a warm air stream casing, for example, 42 or vice versa, subject to the season of the year. The casing 40 comprises a pair of reversible fans 43 and 44. During a winter season, the fan 43 drives the incoming fresh outside air to flow over the condensers 16, and the fan 44 drives the exhausted air to flow over the evaporators 15, thereby providing the heat energy transfer from the exhausted air to the incoming fresh outside air. During a summer season, the fan 44 drives the incoming fresh outside air to flow over the evaporators 15, and the fan 43 drives the exhausted air to flow over the condensers 16, thereby providing the heat energy transfer from the incoming fresh outside air to the removed exhausted air, and thereby reclaiming a heat energy of the air to be cooled.

It will be appreciated by those skilled in the art, that the thermosiphon apparatus and method of the present invention have a substantial advantage over the known prior art technologies for passive heat exchange between mediums having different temperatures:

A limitation on length existing with heat pipes (which are similar to thermosiphon devices in characteristics), is overcome and the apparatus of the present invention is not subject to that limitation due to its unique physical configuration which controls the flow of the transport medium.

In the condenser the heat transport medium exists in two phase condition, with both phases flowing in the same direction. For comparison, in a heat pipe, a liquid and a vapor are moving in opposite directions, each impeding the flow of the other.

Leakage causing cross-contamination through intermixing of the fluid streams is fully prevented with this invention since only the medium transporting heat energy moves between them on the inside of the hermetically sealed individual modules.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. An apparatus for heat exchange between a fluid heat source medium and a fluid heat sink medium, the fluid heat source medium having a higher temperature than the fluid heat sink medium, the apparatus comprising at least one heat transferring individual module, said module comprising:

a header having an upper portion and a lower portion, the header further having a first and a second spaced opposite sides, an evaporator means extended from the first side of the header into the fluid heat source medium, wherein the evaporator means includes a U-shaped tube directly affixed to the lower portion of the header through first and second passes thereof, a condenser means extended from the second side of the header into the fluid heat sink medium, wherein the condenser means includes a U-shaped tube directly affixed to the upper portion of the header through third and fourth passes thereof, the module being charged with a heat transport medium existing in the module in both liquid and vapor phases, a liquid level interface surface being formed between the liquid phase and the vapor phase of the heat transport medium within the header, said liquid level interface surface separating the upper portion of the header from the lower portion thereof, such that the evaporator means is located below the liquid level interface surface and is filled completely with the liquid phase of the heat transport medium, and such that the condenser means is located above the liquid level interface surface and is filled with the vapor phase of the heat transport medium, wherein the heat transport medium within the evaporator means receives a heat energy from the fluid heat source medium and transports the received heat energy to the condenser means through the liquid level interface surface, thereby cooling the fluid heat source medium and thereby heating the fluid heat sink medium.

2. The apparatus of claim 1, wherein the first and the second passes of the header are located at different levels.

3. The apparatus of claim 1, wherein the third and the fourth passes of the header are located at different levels.

4. The apparatus of claim 1, wherein the condenser means has an internal surface treated to increase the internal surface area thereof involved in the heat energy transferring.

5. The apparatus of claim 4, wherein the internal surface of the condenser means is either serrated, rifled, micro-finned or coated.

6. The apparatus of claim 1, further comprising an ebulator means located within the U-shaped tube of the evaporator means.

7. The apparatus of claim 6, wherein the ebulator means extends a full length of the U-shaped tube of the evaporator means.

8. The apparatus of claim 6, wherein the ebulator means is of a triangle cross-section shape.

9. The apparatus of claim 1, wherein the evaporator means has an internal surface treated to increase the internal surface area thereof involved in the heat energy transferring.

10. The apparatus of claim 1, wherein the evaporator means has an internal surface treated by either serrating, rifling, micro-firming, or coating.

11. The apparatus of claim 1, wherein the module is hermetically sealed.

12. The apparatus of claim 1, wherein the module is internally evacuated.

13. The apparatus of claim 1, wherein the first pass in the lower portion of the header is elevated above the second pass in the lower portion of the header, wherein the third pass in the upper portion of the header is elevated above the fourth pass in the upper portion of the header, and wherein an elevation of the condenser means above the evaporator means is determined by an elevation of said fourth pass over said first pass, and is variable, subject to design requirements.

14. The apparatus of claim 1, wherein a quantity of the heat transport medium charged into the module is variable, subject to design requirements.

15. The apparatus of claim 1, further including an interface surface pan installed within the header.

16. The apparatus of claim 1, wherein the header is of an oval shape.

17. The apparatus of claim 1, wherein the header is shaped as a rectangular extrusion.

18. The apparatus of claim 1, wherein the header is shaped as a circular tube.

19. The apparatus of claim 1, further including a plurality of said substantially identical heat transferring individual modules, said individual modules being cascaded in series along the heat source medium and the heat sink medium flow paths.

20. The apparatus of claim 19, further including tiers of said cascaded individual modules, the tiers being arranged in a plane separating the heat source medium and the heat sink medium.

21. The apparatus of claim 1, further including a two-dimensional array of said heat transferring individual modules arranged in a plane separating the heat source medium and the heat sink medium, with the evaporator means of said modules extended into the heat source medium, and with the condenser means of said modules extended into the heat sink medium.

22. An apparatus for heat exchange between a heat source medium and a heat sink medium, the heat source medium having a higher temperature than the heat sink medium, the apparatus comprising a plurality of substantially identical heat transferring individual modules arranged in a two-dimensional array in a plane separating the heat source medium and the heat sink medium, each said heat transferring individual module comprising:

a header having an upper portion and a lower portion, the header further having a first and a second spaced opposite sides, an evaporator means extended from the first side of the header into the heat source medium, wherein the evaporator means includes a U-shaped tube affixed to the lower portion of the header through a first and a second passes located at different levels thereon, a condenser means extended from the second side of the header into the heat sink medium, wherein the condenser means includes a U-shaped tube affixed to the upper portion of the header through a third and a fourth passes thereof located at different levels thereon, each said heat transferring individual module being charged with a heat transport medium and hermetically sealed and internally evacuated, the heat transport medium existing in the module in both liquid and vapor phases, a liquid level interface surface being formed between the liquid phase and the vapor phase of the heat transport medium within the header, said liquid level interface surface separating the upper portion of the header from the lower portion thereof, such that the evaporator means is located below the liquid level interface surface and is filled with the liquid phase of the heat transport medium, and such that the condenser means is located above the liquid level interface surface and is filled with the vapor phase of the heat transport medium, wherein the heat transport medium within the evaporator means receives a heat energy from the heat source medium and transports the received heat energy to the condenser means through the liquid level interface surface, thereby cooling the heat source medium and thereby heating the heat sink medium.

23. A method for heat exchange between a heat source medium and a heat sink medium, the heat source medium having a higher temperature than the heat sink medium, the method comprising the steps of:

providing a plurality of substantially identical heat transferring individual modules, such that each said module comprises:

a header having an upper portion and a lower portion, the header further having a first and a second spaced opposite sides, a U-shaped tube-type evaporator means affixed to the lower portion of the header through a first and a second passes located at different levels thereon, and a U-shaped tube-type condenser means affixed to the upper portion of the header through a third and a fourth passes located at different levels thereon;

charging each said module with a heat transport medium and hermetically sealing and internally evacuating the same; and arranging said plurality of said modules in a two-dimensional array in a plane separating the heat source medium and the heat sink medium, with the evaporator means of each said module extended from the first side of the header into the heat source medium, and with the condenser means of each said module extended from the second side of the header into the heat sink medium;

wherein the heat transport medium within the evaporator means receives a heat energy from the heat source medium and transports the received heat energy to the condenser means through the liquid level interface surface, thereby cooling the heat source medium and thereby heating the heat sink medium.

24. The method of claim 23, further including the step of counterflowing the heat source medium and the heat sink medium.

25. The method of claim 23, wherein the heat transport medium exists in the module in both liquid and vapor phases, such that a liquid level interface surface is formed between the liquid phase and the vapor phase of the heat transport medium within the header, said liquid level interface surface separating the upper portion of the header from the lower portion thereof, such that the evaporator means is located below the liquid level interface surface and is filled with the liquid phase of the heat transport medium, and such that the condenser means is located above the liquid level interface surface and is filled with the vapor phase of the heat transport medium.

26. The method of claim 23, further including the step of increasing an internal surface area of the condenser means by means of serrating, rifling, micro-finning or coating thereof.

27. The method of claim 23, further comprising the step of placing an ebulator means within the U-shaped tube of the evaporator means.

28. The method of claim 23, wherein the ebulator means extends a full length of the evaporator means and has a triangle cross-section shape.

29. The method of claim 23, further comprising the step of increasing an internal surface area of the evaporator means by either serrating, rifling, micro-finning, or coating.

30. In combination with a ventilation system supplying a fresh outside air to a habitable space and removing an exhausted air therefrom, wherein the incoming fresh outside air is to be warmed or cooled subject to the season of the year in order to maintain a comfortable temperature in the habitable space, and wherein warming or cooling of the incoming fresh outside air requires an energy consumption, an apparatus for passive heat exchange between the incoming fresh outside air and the removed exhausted air comprising a two-dimensional array of substantially identical heat transferring individual modules, each module comprising:

a header having an upper portion and a lower portion, the header further having a first and a second spaced opposite sides, an evaporator means extended from the first side of the header into a flow of the air to be cooled, wherein the evaporator means includes a U-shaped tube affixed to the lower portion of the header through a first and a second passes thereof, a condenser means extended from the second side of the header into flow of the air to be warmed, therein the condenser means includes a U-shaped tube affixed to the upper portion of the header through a third and a fourth passes thereof, the module being charged with a heat transport medium existing in the module in both liquid and vapor phases, a liquid level interface surface being formed between the liquid phase and the vapor phase of the heat transport medium within the header, said liquid level interface surface separating the upper portion of the header from the lower portion thereof, such that the evaporator means is located below the liquid level interface surface and is filled with the liquid phase of the heat transport medium, and such that the condenser means is located above the liquid level interface surface and is filled with the vapor phase of the heat transport medium, wherein the heat transport medium within the evaporator means receives a heat energy from the air to be cooled and transports the received heat energy to the condenser means through the liquid level interface surface, thereby cooling the air to be cooled and heating the air to be warmed.

31. The apparatus of claim 30, wherein during the winter season the heat energy is transferred from the exhausted air to the incoming air.

32. The apparatus of claim 30, wherein during the summer season the heat energy is transferred from the incoming air to the exhausted air.

33. The apparatus of claim 30, further includes a casing and a first and a second reversible fans installed in the casing, wherein during a winter season, the first fan drives the incoming fresh outside air to flow over the condenser means, and the second fan drives the exhausted air to flow over the evaporator means, thereby providing the heat energy transfer from the exhausted air to the incoming fresh outside air, and wherein during a summer season, the second fan drives the incoming fresh outside air to flow over the evaporator means, and the first fan drives the exhausted air to flow over the condenser means, thereby providing the heat energy transfer from the incoming fresh outside air to the removed exhausted air.

* * * * *